US007641529B2

(12) United States Patent
Deville et al.

(10) Patent No.: US 7,641,529 B2
(45) Date of Patent: Jan. 5, 2010

(54) LIFE-SAVING GARMENT

(75) Inventors: Charles Deville, Saint Jean de Luz (FR); Nicolas Pele, Hendaye (FR); Maider Itoiz, Villefranque (FR)

(73) Assignee: Decathlon, Villeneuve d'Ascq (FR)

( * ) Notice: Subject to any disclaimer, the term of this patent is extended or adjusted under 35 U.S.C. 154(b) by 0 days.

(21) Appl. No.: 11/797,709

(22) Filed: May 7, 2007

(65) Prior Publication Data

US 2007/0287343 A1 Dec. 13, 2007

(30) Foreign Application Priority Data

May 18, 2006 (FR) ..... 06 04462

(51) Int. Cl.
*B63C 9/08* (2006.01)

(52) U.S. Cl. ..... 441/123

(58) Field of Classification Search ..... 441/123, 441/104; 114/104, 123
See application file for complete search history.

(56) References Cited

U.S. PATENT DOCUMENTS 1,272,336 A * 7/1918 Edomonds ..... 441/112
1,500,665 A * 7/1924 Blankenhagen ..... 441/115
2,351,777 A * 6/1944 Morner ..... 441/104
3,493,973 A * 2/1970 Armstrong ..... 2/74
3,956,786 A 5/1976 O'Link
4,871,338 A 10/1989 Hoffman
6,511,357 B1 1/2003 Williams et al.

FOREIGN PATENT DOCUMENTS

DE 1 121 964 B 1/1962
GB 124 986 A 4/1919
GB 1 205 607 A 9/1970
GB 2082979 * 3/1982 ..... 441/123

* cited by examiner

*Primary Examiner*—Stephen Avila
(74) *Attorney, Agent, or Firm*—Kenyon & Kenyon LLP

(57) ABSTRACT

This present invention relates to a life jacket that includes a collar that is intended to be positioned behind the head of the wearer, and a main body attached to two lateral extremities of the collar. This life jacket includes positioning resources designed to pass the collar from a down position, in which it is intended to rest upon the top of the back, to an up position, in which it is intended to rest behind the head of the wearer.

20 Claims, 1 Drawing Sheet

LIFE-SAVING GARMENT

Figure 1:
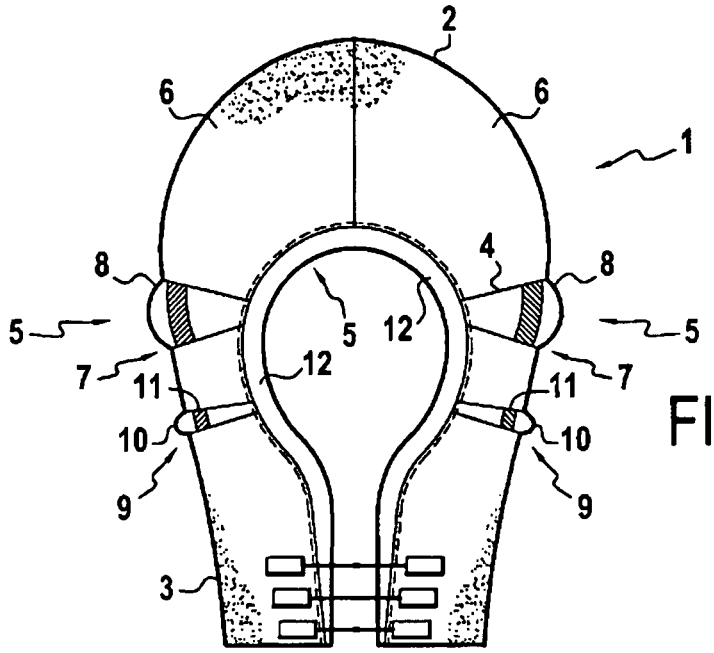

This application claims priority to French Patent Application No. 06/04462 filed 18 May 2006, the content of which is incorporated herein by reference.

This present invention concerns a life-saving garment, in particular intended for rescue at sea.

The principal application of the invention is in the creation of a life jacket intended to be worn by individual adults or children engaged in nautical activities, whether in a professional capacity, and fishing crews in particular, or members of the merchant navy, coastguards, coastal rescue crews or the staff of oil rigs, but also for leisure activities and in particular intended for pleasure sailors, regatta crews, etc.

This garment can consist, though not exclusively, of a jacket or vest, and it is this example which will be detailed in this present application.

Nevertheless, the solutions described for the jacket are also easily transferable to other types of garment covered by the invention, such as watch-keepers' jackets in particular, or indeed work overalls.

Many types of life jacket exist on the market and standardised life jackets in particular.

A first particularly common type of life jacket is a keyhole model of generally triangular design with a hole for passage of the wearer's head.

This type of life jacket nevertheless has drawbacks, and in particular its structure is relatively rigid and cannot be worn continuously in comfort by a user.

In other words, this life jacket is worn only when immediate danger is foreseen, and in particular in the event of a sinking incident.

Another type of particularly common life jacket consists of a jacket that surrounds the trunk of the wearer and that has two openings for passage of the arms and a hood at the collar. This type of jacket is used particularly in nautical sports.

This type of jacket has one major drawback in that it does not have a neck design that adequately protects the neck of the user.

This drawback is particularly troublesome because this is a very vulnerable area, in particular because of the position of a person overboard at sea, when the head and as a consequence the respiratory tracts must be kept clear and protected from the water in order to increase the chances of survival.

This present invention has as its purpose to overcome the aforementioned drawbacks, and to this end, to propose a life jacket that can be worn continuously by a user without being an impediment to his activities.

Another objective of this present invention is to propose a life jacket which, when the user is in the water, provides optimum support for the head, that is at the sides and at the rear.

Another objective of this present invention is to propose a life jacket that, once fitted, requires no particular manipulation of the jacket.

Another objective of this present invention is to propose a life jacket that is particularly strong and reliable.

To this end, the life jacket according to invention includes a collar that is intended to be positioned behind the head of a user, and a main body attached to two lateral extremities of the collar.

According to the invention, the jacket also includes positioning resources designed to pass the collar from a down position, in which it is intended to rest upon the top of the back, to an up position, in which it is intended to rest behind the head.

This characteristic of the positioning resources is used to create a life jacket with two positions, one called the rest position corresponding to the configuration of the life jacket when the user is out of the water, and a so-called safety position with the collar raised and holding the head at the sides and at the back, when in the water.

According to the invention, the collar has a convex configuration in the down position and a concave configuration in the up position.

This characteristic allows the shape of the collar to be adjusted as a function of its position either at the back of the user, or behind the head of the user.

According to the invention, it is arranged advantageously that the positioning resources include elastic tensioning resources between the main body and the collar, and/or between different elements of the collar, and a hinge to provide a pivoting connection between the body and the collar.

This advantageous characteristic allows automatic passage between the two positions of the life jacket when the user falls into the water, with passage to the concave position being obtained by the pressure of the water on the collar, and with passage from the concave position to the convex position being effected manually.

Advantageously, the hinge can include a collar that is designed to at least partially hug the neck of the user, and that is connected to the main body, this collar being surrounded by a strip of material connected to or forming part of the collar. This arrangement allows good positioning of the life jacket on the user, and in particular in the area of the neck and shoulders, and provides close contact between the jacket and the lower part of the neck.

In an implementation variant, it is arranged that the elasticity of the tensioning resources is not placed at the junction between the collar parts, but at the collar parts themselves, using deformable foams whose controlled deformation creates the elastic tension.

In this implementation variant, the junction zones between the collar parts are pre-tensioned.

Like the first method of implementation of the elastic tensioning resources, there is again automatic passage between the two positions of the life jacket when the user falls into the water, because of the pressure of the water exerted on the collar.

According to the invention, it is also possible to arrange that the tensioning resources include a bellows or concertina element and at least one elastic element connecting the collar to the top edge of part of the main body.

This arrangement firstly enables the passage of water between the collar and the main body to be prevented and, secondly protects the elastic element and in particular reduces the risk of tearing the latter.

According to the invention, it is also possible to arrange, in addition to the tensioning resources, for additional tensioning resources that also include a bellows or concertina element and at least one elastic element connecting two parts of the body.

This characteristic favours the deformation of the collar and as a consequence the passage from the convex configuration to the concave position, with the transition being achieved more rapidly on entry of the life jacket into the water.

According to the invention, the collar can be composed of one or more pockets, each of which can accommodate a buoyancy block.

In the case of a collar that has at least two pockets, it is arranged that the connection between the pockets should allow relative angular movement of the pockets allowing the collar to assume a substantially rounded shape that hugs the shape of the neck and the lower head.

Figure 2:
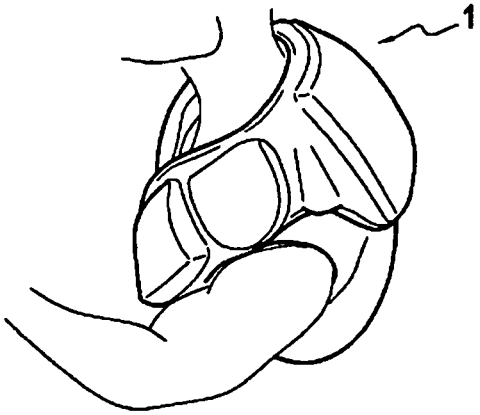
Figure 3:
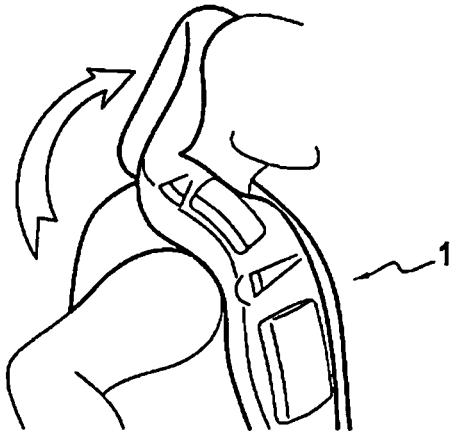
Figure 4:
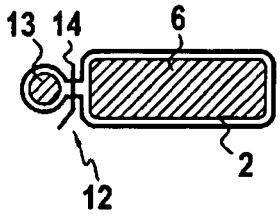

This present invention will be understood more clearly on reading the description that follows of a preferred example of implementation, where this description is provided only by way of a non-limiting example, with reference to the appended drawings in which:

FIG. 1 schematically represents an example of implementation of a life jacket according to invention, placed flat, FIG. 2 represents a view in perspective of a life jacket placed on a model, the life jacket being in the rest position, FIG. 3 represents the life jacket shown in FIG. 2, here placed in the safety position, FIG. 4 shows a detail of the implementation of the life jacket.

Referring mainly to FIG. 1, we see a life jacket 1 that includes a collar 2 and a main body 3. The main body 3 is attached to the collar 2 at the lateral extremities 4 of the said collar.

The life jacket 1 also includes positioning resources 5.

These positioning resources 5 can be placed at different heights on the jacket 1, and the term collar 2 refers, in the remainder of the application, to the part of the life jacket 1 that can pass from a down position to an up position, where this part can be of various dimensions.

In particular, as illustrated in the appended drawings, this collar can substantially constitute a half-collar. However, it is also possible to create life jackets with collars that surround the head of the user.

This collar 2 can be composed of one or more pockets 6, where each pocket 6 accommodates a buoyancy block.

In the method of implementation of FIGS. 1 to 4, it can be seen that the collar 2 includes two pockets 6 attached to each other.

Advantageously, the connection between the pockets 6 allows angular movement of the pockets 6 in relation to each other.

Regarding the positioning resources 5, we see particularly in FIG. 1 that they include elastic tensioning resources 7 composed of an elastic strip, associated with a bellows or concertina element 8. When the pressure of the water on the rear of the collar 2 is sufficiently high, these positioning resources 5 allow the deformation of the collar 2, which passes from a convex position to a concave position, with this latter position providing back and side support for the person in the water.

In order to facilitate this deformation, it is also possible to arrange for additional tensioning resources 9, where these tensioning resources 9 can be of reduced dimensions in relation to tensioning resources 7, but of a similar structure and in particular can include a bellows or concertina element 10 and at least one elastic element 11 connecting the two parts of the main body 3.

Advantageously, the main body 3 includes two additional tensioning resources 9 placed in the vicinity of the tensioning resources 7 between the main body 3 and the collar 2.

In the implementation example of FIGS. 1 to 4, the elastic tensioning resources 7 are placed between the main body 3 and the collar 2.

Advantageously, the elastic tensioning resources 7 are positioned at the lateral extremities 4 of the collar. Nevertheless it is also possible to arrange that these tensioning resources 7 could also be placed between different elements of the collar 2, in particular when the latter is composed of several pockets 6.

By now referring to FIGS. 1 and 4, it can be seen that the positioning resources 5 include a hinge 12, where this hinge 12 allows the collar 2 to pivot in relation to the main body 3.

Thus, the elastic tensioning resources 7 allow a deformation of the collar 2 and the hinge 12, so as to allow this collar 2 to pivot in relation to the main body 3.

Advantageously, this hinge 12 is composed of a collar 13 connected firstly to the main body 3, and secondly connected by a strip of material 14 to the collar 2 or incorporated into this collar 2.

Advantageously, at the top, the collar 13 is of a substantially cylindrical configuration so that it can at least partially hug the neck of the user.

Referring to FIG. 2, we see a life jacket 1 placed on a model which corresponds to the rest position of the life jacket, that is where the jacket has its collar 2 in the convex configuration.

Under the effect of the pressure of the water, shown by the upward arrow in FIG. 3, on immersing the model, the collar will move away from the back of the wearer and deform, with this deformation being enabled by the elastic tensioning resources 7.

The collar 2 can then pivot into the up position, with the pivoting action being allowed by the hinge 12, to take up the position represented in FIG. 3.

Once a secure position has been established, the user can easily re-position the collar 2, into the position of FIG. 2, by holding the upper extremities of the collar 2 for example, and pulling backwards.

We thus see how the structure of the life jacket 1 allows us to create a jacket 1 that is easy to operate and provides the user with characteristics of safety and comfort.

According to an advantageous characteristic of the invention, it is also arranged that the security aspect is further enhanced by fitting onto the collar 2, elements that increase the visibility of the jacket, such as reflecting elements, which can include reflecting "patches" for example.

Naturally, other characteristics that are within the scope of the professional in this area can also be envisaged without moving outside the coverage of the invention as determined by the following claims.

The invention claimed is:

1. A life-saving garment that includes a first collar, intended to be positioned behind the head, and a main body attached to two lateral extremities of the collar, wherein the garment includes positioning resources designed to pass the first collar from a down position, in which it is intended to rest upon the top of the back, to an up position, in which it is intended to rest upon the back of the head, where the positioning resources include elastic tensioning resources located between the first collar and the main body and a hinge comprising a a second collar that is designed to at least partially hug the neck of the user and connected on one hand over a first portion to the main body and on the other hand over a second portion to the first collar, said hinge providing a pivoting connection between the body and the first collar, thereby allowing automatic passage between the down position and the said up position.

2. A life-saving garment according to claim 1, wherein the first collar has a convex configuration in the down position and a concave configuration in the up position.

3. A life-saving garment according to claim 1, wherein said second collar is surrounded by a strip of material connected to or forming part of the first collar.

4. A life-saving garment according to claim 1, wherein the elastic tensioning resources are placed at the lateral extremities of the first collar.

5. A life-saving garment according to claim 4, wherein the tensioning resources include a bellows or concertina element and at least one elastic element connecting the first collar to the top edge of part of the main body.

6. A life-saving garment according to claim 5, wherein the main body includes additional tensioning resources that include a bellows or concertina element and at least one elastic element connecting two parts of the said body and favoring the deformation of the first collar.

7. A life-saving garment according to claim 6, wherein the main body includes two additional tensioning resources placed in the vicinity of the tensioning resources between the main body and the first collar.

8. A life-saving garment according to claim 1, wherein the first collar is composed of at least one pocket, where the pocket or pockets each hold a buoyancy block, and whose connection allows a degree of angular movement, in particular of the pockets, in relation to each other.

9. A life-saving garment according to claim 1, wherein the first collar includes reflecting elements, and in particular reflecting "patches".

10. A life-saving garment according to claim 1, intended for nautical applications.

11. A life-saving garment according to claim 3, wherein the elastic tensioning resources are placed at the lateral extremities of the first collar.

12. A life-saving garment according to claim 11, wherein the tensioning resources include a bellows or concertina element and at least one elastic element connecting the first collar to the top edge of part of the main body.

13. A life-saving garment according to claim 12, wherein the main body includes additional tensioning resources that include a bellows or concertina element and at least one elastic element connecting two parts of the said body and favoring the deformation of the first collar.

14. A life-saving garment according to claim 2, wherein the first collar is composed of at least one pocket, where the pocket or pockets each hold a buoyancy block, and whose connection allows a degree of angular movement, in particular of the pockets, in relation to each other.

15. A life-saving garment according to claim 3, wherein the first collar is composed of at least one pocket, where the pocket or pockets each hold a buoyancy block, and whose connection allows a degree of angular movement, in particular of the pockets, in relation to each other.

16. A life-saving garment according to claim 4, wherein the first collar is composed of at least one pocket, where the pocket or pockets each hold a buoyancy block, and whose connection allows a degree of angular movement, in particular of the pockets, in relation to each other.

17. A life-saving garment according to claim 2, wherein the first collar includes reflecting elements, and in particular reflecting "patches".

18. A life-saving garment according to claim 3, wherein the first collar includes reflecting elements, and in particular reflecting "patches".

19. A life-saving garment according to claim 2, intended for nautical applications.

20. A life-saving garment according to claim 9, intended for nautical applications.

* * * * *